US008172067B1

(12) United States Patent
Folk et al.

(10) Patent No.: US 8,172,067 B1
(45) Date of Patent: May 8, 2012

(54) CANCEL TRANSACTION AND RETURN OF SAME FUNDS

(75) Inventors: Amy Baker Folk, Charlotte, NC (US); Daniel Christopher Bohen, Charlotte, NC (US)

(73) Assignee: Bank of America Corporation, Charlotte, NC (US)

( * ) Notice: Subject to any disclaimer, the term of this patent is extended or adjusted under 35 U.S.C. 154(b) by 52 days.

(21) Appl. No.: 12/485,389

(22) Filed: Jun. 16, 2009

Related U.S. Application Data

(60) Provisional application No. 61/100,327, filed on Sep. 26, 2008.

(51) Int. Cl.
*G07F 7/04* (2006.01)

(52) U.S. Cl. ..... 194/206

(58) Field of Classification Search ..... 194/206, 194/200, 350, 205, 207; 902/8, 9, 12; 235/379; 209/534; 705/16, 17
See application file for complete search history.

(56) References Cited

U.S. PATENT DOCUMENTS

| | | | | |
|---|---|---|---|---|
| 3,937,453 | A * | 2/1976 | Hickey et al. | 271/4.09 |
| 4,365,700 | A * | 12/1982 | Arimoto et al. | 194/206 |
| 4,980,543 | A * | 12/1990 | Hara et al. | 235/379 |
| 2004/0245066 | A1 * | 12/2004 | Ichikawa et al. | 194/206 |
| 2005/0150738 | A1 * | 7/2005 | Hallowell et al. | 194/206 |
| 2006/0157390 | A1 * | 7/2006 | Otsuka | 209/534 |

* cited by examiner

*Primary Examiner* — Mark Beauchaine
(74) *Attorney, Agent, or Firm* — Banner & Witcoff, Ltd.; Michael A. Springs

(57) ABSTRACT

The present invention supports processing a transaction by a cash handling device. With one aspect, a cash recycling device includes a plate that covers a stacking cassette in order to prevent a deposited note from entering the stacking cassette before the transaction is completed by the user. The plate retracts to allow the deposited note to enter the stacking cassette when the transaction is completed. If the transaction is canceled, all notes on top of the plate are returned to the user. With another aspect, a cash recycling device extracts a deposited note from a stacking cassette if the user cancels the transaction. If a double pick occurs, the extracted note is diverted to a divert cassette. The first extracted note of the double pick is returned to the user. The remaining extracted notes are returned to the stacking cassette. The process may be repeated for all deposited notes.

21 Claims, 7 Drawing Sheets

CANCEL TRANSACTION AND RETURN OF SAME FUNDS

CROSS-REFERENCE TO RELATED APPLICATIONS

This application claims priority to U.S. provisional patent application Ser. No. 61/100,327, filed Sep. 26, 2008, entitled "Cancel Transaction and Return of Same Funds," hereby incorporated herein by reference as to its entirety.

BACKGROUND OF THE INVENTION

Cash flow refers to the movement of cash over a particular time period within a business or enterprise. The calculation of cash flow may be used as one measure to gauge financial health of the business. Managers in charge of cash flow management may use various tools to assist in making decisions involving cash flow including cash recyclers which allow a retail establishment to maintain and re-use an amount of currency on-site. The cash recycler may further calculate and manage use of cash flows in real-time.

While cash recyclers allow a business to manage their cash flows in a more seamless manner, recyclers are often unable to reconcile the cash flows with individual employee accounts. Thus, employees of a business must typically withdraw their tips or other take-home income in the form of cash at the end of their shift. Furthermore, displaced cash is less easily recovered than with other forms of payments (e.g., debit card, pre-paid card, or mobility devices).

While cash recyclers enable a user to deposit cash (bank notes) that may recycled for subsequent transactions, the user may decide to alter the transaction for some reason before completing the transaction. Consequently, it is advantageous that the cash recycle have flexibility to support such user scenarios.

SUMMARY OF THE INVENTION

The following presents a simplified summary in order to provide a basic understanding of some aspects of the invention. The summary is not an extensive overview of the invention. It is neither intended to identify key or critical elements of the invention nor to delineate the scope of the invention. The following summary merely presents some concepts of the invention in a simplified form as a prelude to the description below.

In one aspect of the invention, an end-to-end currency, handling and servicing apparatus is provided to any cash-centric business or enterprise. In various embodiments, the method, apparatus, and system may provide cash register till set up and balancing, back office reconciliation, and other cash payment handling activities.

In an aspect of the invention, a cash recycling apparatus is utilized to receive currency deposits and recycle the deposited currency for withdrawals. In an embodiment, the cash recycling apparatus may scan each deposit for counterfeits bills.

In another aspect of the invention, a currency recycling apparatus may be placed in each of a business customer's stores or locations. The currency recycling machines may be networked. In an embodiment, after each cashier shift or at other designated times, contents of a cashier's register till or drawer may be deposited into a currency recycling apparatus. In another embodiment, at shift start the currency recycling apparatus may withdraw a determined amount of cash in various denominations so as to stock a cashier's cash register till or drawer.

Furthermore, in an aspect of the invention contents and data from each of the networked currency recycling machines may be analyzed to determine real-time cash positions. In an embodiment, the real-time cash positions may be used to make projections and/or decisions regarding short and long term business decisions.

In yet another aspect of the invention, each of the currency recycling machines may be connected to a financial institution's network or infrastructure. In an embodiment, each deposit or withdrawal via the currency recycling machine may be credited or debited real-time to a customer's account. In another embodiment, real-time crediting and debiting of a customer's account may allow the customer to have immediate access to the customer's recent deposits and current balance for use in future transactions or for planning and forecasting.

In yet another aspect of the invention, a cash recycling device includes a plate that covers a stacking cassette in order to prevent a deposited note from entering the stacking cassette before a transaction is completed by a user. The plate retracts to allow the deposited note to enter the stacking cassette when the transaction is completed. If the transaction is canceled, all notes on top of the plate are returned to the user. Embodiments also support transactions in which a plurality of notes are deposited and where different stacking cassettes are allocated for notes of different denominations.

In yet another aspect of the invention, a cash recycling device extracts a deposited note from a stacking cassette if a user cancels a transaction. If a double pick occurs (more than one note is extracted from the stacking cassette), the extracted noted is diverted to a divert cassette. A deposited note corresponds to the first extracted note of the double pick and is returned to the user. The remaining extracted notes are returned to the stacking cassette. The process may be repeated for all of the deposited notes that are contained in the stacking cassette. Embodiments support transactions in which different stacking cassettes are allocated for notes of different denominations.

BRIEF DESCRIPTION OF THE DRAWINGS

The present disclosure is illustrated by way of example and not limited in the accompanying figures in which like reference numerals indicate similar elements.

DETAILED DESCRIPTION

In accordance with various aspects of the disclosure, systems and methods are illustrated for providing currency handling services and management. A financial institution such as a bank may provide immediate access and use of funds recently deposited using the currency handling apparatus, system, and method described below. For illustrative purposes the financial instrument discussed throughout the below description is cash. However, as those skilled in the art will realize, the described aspects of the invention are not limited to just cash (paper money and coins) but may also include other forms of liquid assets such as checks, bank notes, and money orders.

Cash handling devices generally refer to devices that are configured to accept and/or dispense currency. Cash handling devices include payment kiosks, point of sale systems such as cash registers, automated teller machines (ATMs), currency recyclers and the like. Currency recyclers generally refer to cash handling devices that are configured to dispense the same currency that was earlier deposited. For example, if a user deposits a 5 dollar bill into a cash recycler machine, the same 5 dollar bill may be dispensed during a subsequent withdrawal transaction. Thus, using currency recyclers, deposited currency may be placed immediately back into use and circulation instead of being held or frozen until a bank is able to collect and reconcile the funds, stored indefinitely and/or taken out of circulation entirely as is the case with other current cash handling devices.

Figure 1:
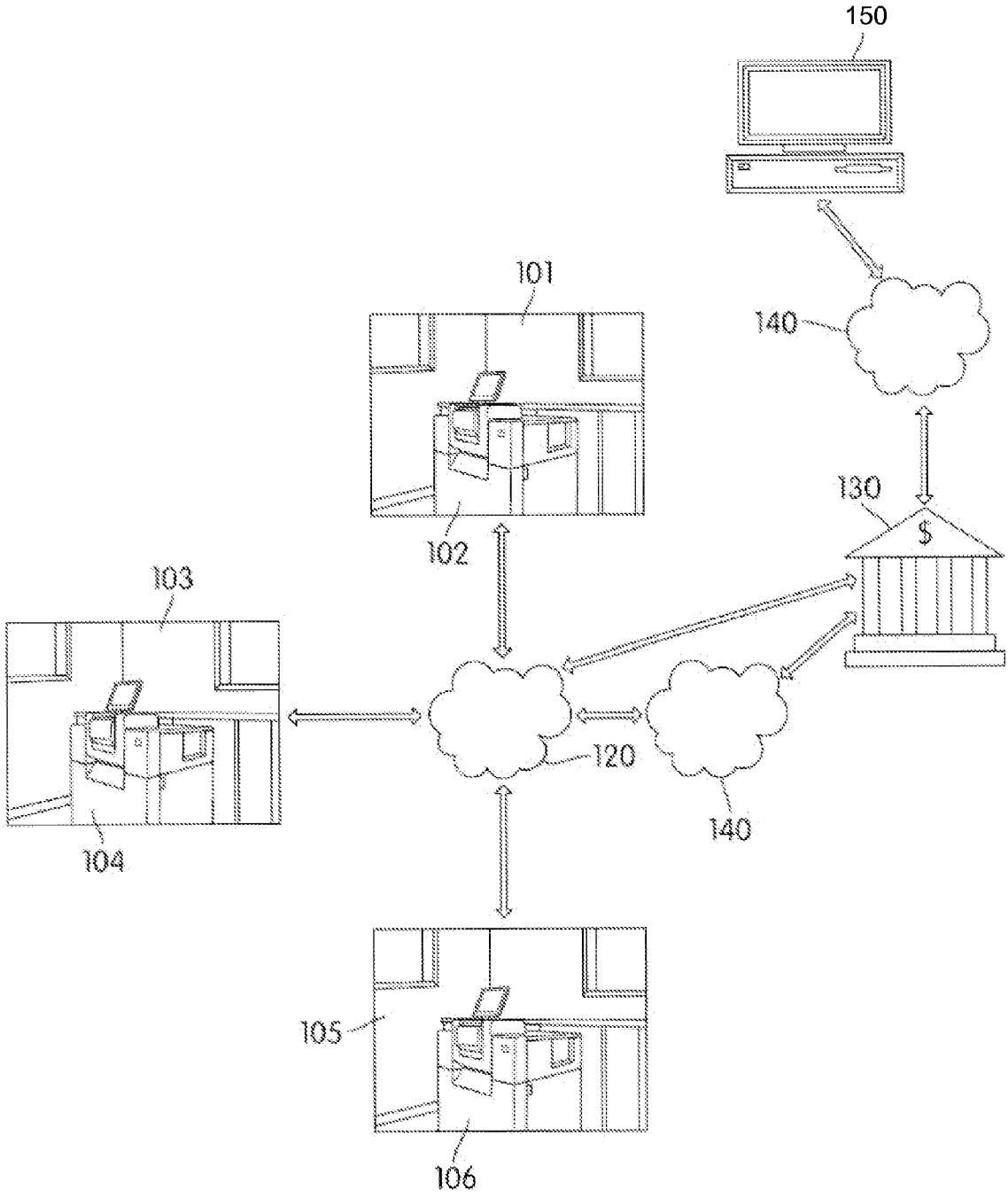
FIG. 1 illustrates an example of a suitable operating environment in which various aspects of the disclosure may be implemented.

FIG. 1 illustrates an example of a suitable operating environment in which various aspects of the disclosure may be implemented. Devices 102, 104, 106 may include currency recyclers and/or other cash handling devices and may be located at various sites such as locations 101, 103, and 105. The locations may represent different stores of a business enterprise. For example, locations 101, 103, and 105 may represent three different grocery stores located in different geographical areas belonging to a grocery store chain. Those skilled in the art will realize that additional cash handling devices may be located in the same store or in other stores belonging to the grocery store chain. In addition, those skilled in the art will realize that a grocery store chain is only one illustrative example of the types of locations or businesses that cash handling devices such as recyclers may be located. For example, cash recyclers may also be located in gas stations, post offices, department stores, and other places where cash and other financial instruments are deposited or withdrawn.

FIG. 1 further illustrates that cash handling devices 102, 104, and 106 may be connected to a communications network such as communications network 120. Communications network 120 may represent: 1) a local area network (LAN); 2) a simple point-to-point network (such as direct modem-to-modem connection); and/or 3) a wide area network (WAN), including the Internet and other commercial based network services.

Cash handling devices 102, 104, and 106 may communicate with one another or with a financial institution such as bank 130 via communication network 120 in various manners. For example, communications between cash handling devices 102, 104, 106 and bank 130 may use protocols and networks such as TCP/IP, Ethernet, FTP, HTTP, BLUETOOTH, Wi-Fi, ultra wide band (UWB), low power radio frequency (LPRF), radio frequency identification (RFID), infrared communication, IrDA, third-generation (3G) cellular data communications, Global System for Mobile communications (GSM), or other wireless communication networks or the like. Communications network 120 may be directly connected to a financial institution such as bank 130. In another embodiment, communications network 120 may be connected to a second network or series of networks 140 before being connected to bank 130. According to one or more arrangements, bank 130 may utilize an infrastructure which includes a server 150 having components such as a memory, a processor, a display, and a communication interface.

Figure 2:
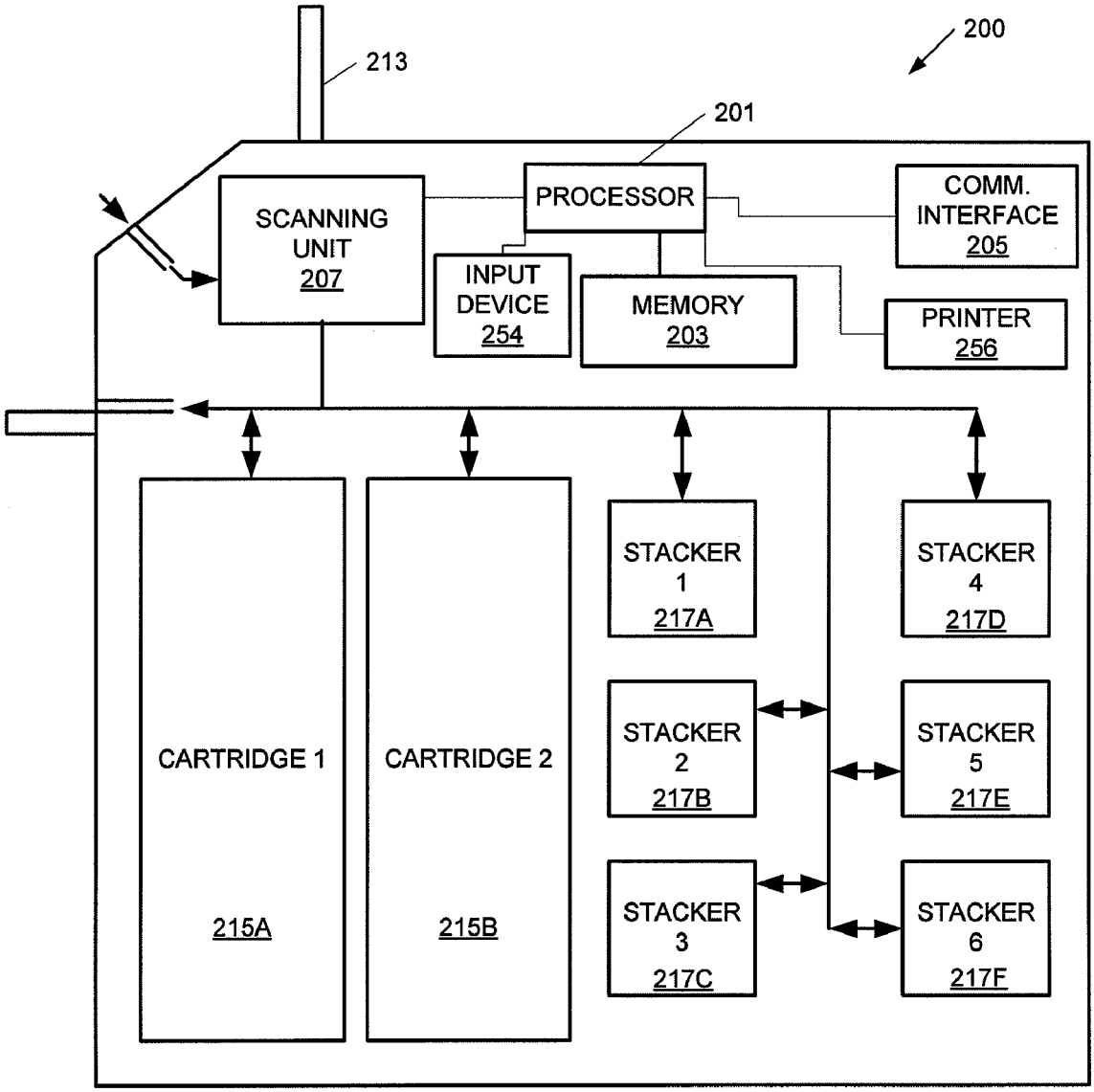
FIG. 2 illustrates a simplified diagram of a currency recycler in accordance with an aspect of the invention.

FIG. 2 illustrates a simplified diagram of a cash recycler that may be used in accordance with the operating environment of FIG. 1. Cash recycler 200 may include processor 201, memory 203, communication interface 205, scanning unit 207, display 213 and various cartridges 215 and stackers 217. Processor 201 may be generally configured to execute computer-readable instructions stored in memory 203 such that, for example, cash recycler 200 may send and receive information to and from a bank (e.g., bank 130 of FIG. 1) using communication interface 205 and via a network (e.g., networks 120 and/or 140 of FIG. 1). Memory 203 may be configured to store a variety of information including the aforementioned computer-readable instructions, funds balance data, reconciliation data, user account information and the like. Additionally, memory 203 may include non-volatile and/or volatile memory. One or more databases may be stored in the memories 108, 112, and 116.

Cash recycler 200 may further provide display 213 to present data and/or messages to a user. For example, display 213 may be configured to display a recycler balance, a transaction interface, a current deposit count, security options, transportation options and the like. One or more input devices 254 such as a keypad, keyboard, mouse, touchscreen, fingerprint scanner, retinal scanner, proximity card reader, RFID scanner and/or writer, magnetic card reader, barcode reader, and/or combinations thereof, or any other type of input device or reader capable of inputting, reading, or scanning indicia or information, may also be included in or connected to recycler 200. One or printers 256 may also be included in or connected to recycler 200 for printing receipts and notifications as well.

In cash recycler 200, stackers 217 and cartridges 215 are configured to store currency. Currency may be inserted through input slot 209 and withdrawn through withdrawal slot 211. Stackers 217 may be used to store and organize currency based on denomination. For example, all $5 bills may be stored in stacker 2 (i.e., stacker 217B) while all $20 bills may be stored in stacker 3 (i.e., stacker 217C). Cartridges 215A and 215B, on the other hand, may be used to store overflow currency and/or currency for transport. Thus, if stackers 217 become full, additional currency that is deposited into recycler 200 may be stored in an overflow cartridge such as cartridge 215B. One of cartridges 215 may be designated as a transport cartridge that stores currency to be withdrawn from the machine and transported to the bank. Alternatively or additionally, one or more of cartridges 215 may be used as an unfit bill store for currency determined to be defective to a degree that it should be taken out of circulation. Cartridges 215 and stackers 217 may further be removable for easier access or transport.

Scanning unit 207 may be configured to scan each bill or currency that is inserted into recycler 200. Scanning unit 207 may be configured to detect defects, counterfeits, denomination, type of currency (e.g., which country the currency originates from) and the like. Scanning unit 207 may further be configured to refuse money (either through input slot 209 or withdrawal slot 211) if it cannot be properly recognized or if the currency is deemed to be counterfeit. Scanning unit 207 may send such data to processor 201 which may, in turn, save the data in memory 203.

Further, recycler 200 may include one or more mechanical or electromechanical systems (not shown) for automatically transferring currency between stackers 217, cartridges 215, input slot 209 and withdrawal slot 211 in recycler 200. For example, currency may automatically be withdrawn from stackers 217 and directed into cartridge 215A for storage using a series of motorized rollers. In another example, currency stored in cartridge 215A may be withdrawn and organized and stored into stackers 217 according to denomination. Using such systems to facilitate the automated movement of currency between storage components and other portions of recycler 200 may provide efficiency and security by alleviating some of the need to manually handle currency stored within recycler 200.

Figure 3:
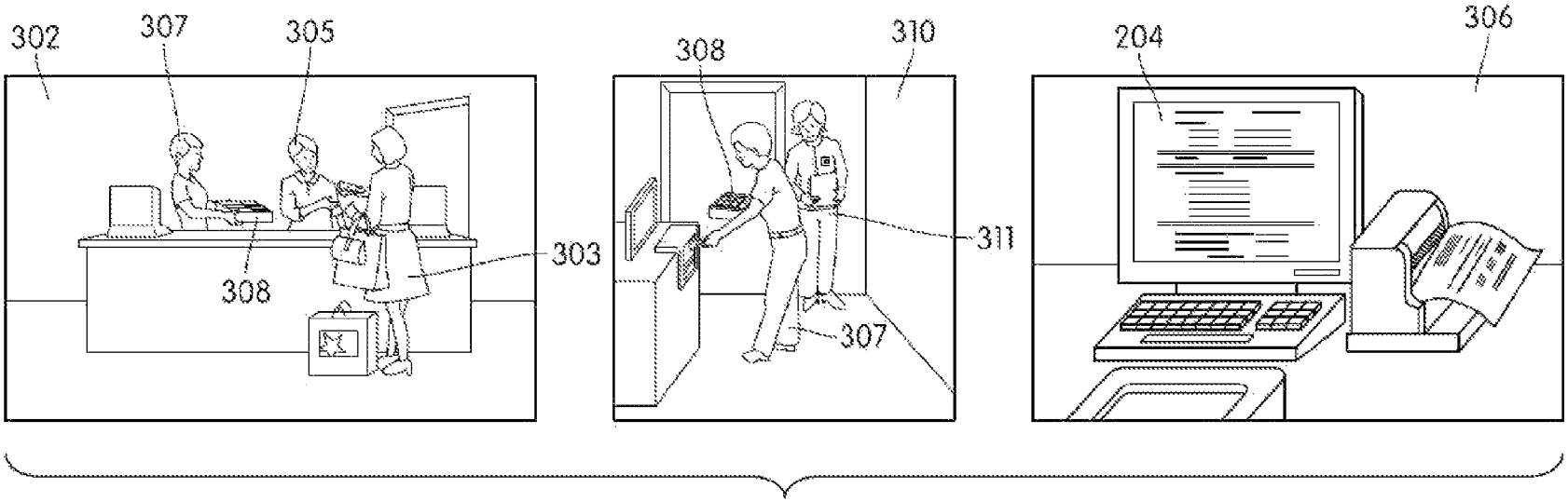
FIG. 3 illustrates various features of a currency recycler that may be used in accordance with aspects of the invention.

FIG. 3 illustrates various features of cash recycler, such as cash recycler 200 of FIG. 2, used in various aspects of the invention. The images in FIG. 3 depict use of a single cash recycler 200 in a retail environment. The retail owner may have a cash recycler 200 located in each of their stores. In an aspect of the invention, summary information for the retail owner's stores may be available via an interface to the financial institution. In another embodiment, access to summary information may be available directly from each of the cash recyclers 200.

In FIG. 3, image 302 depicts customer 303 paying cash to a retail employee such as store cashier 305 for a purchase. Another store cashier 307 at a recently closed cash register may be carrying a cash drawer or till 308 to a back office for reconciliation. In image 310, store cashier 307 may load currency from cash register till 308 into cash recycler 200. In addition, store cashier 307 may also deposit other paper forms of payment received from customer such as checks. An office manager 311 may be supervising cashier 307 during the loading of cash register till 308 into cash recycler 200. Moreover, upon the start of a shift a cashier may fill his/her cash register till with a designated amount of currency dispensed from cash recycler 200.

In image 306 of FIG. 3, a display screen (e.g., display 213 of cash recycler 200 of FIG. 2) may show the total amount entered into cash recycler 200 from till 308. The display screen 213 may breakout the amount entered into cash recycler 200 by denomination and by each cashier. The total amount deposited and withdrawn from cash recycler 200 may be shown on display screen 213.

Figure 4:
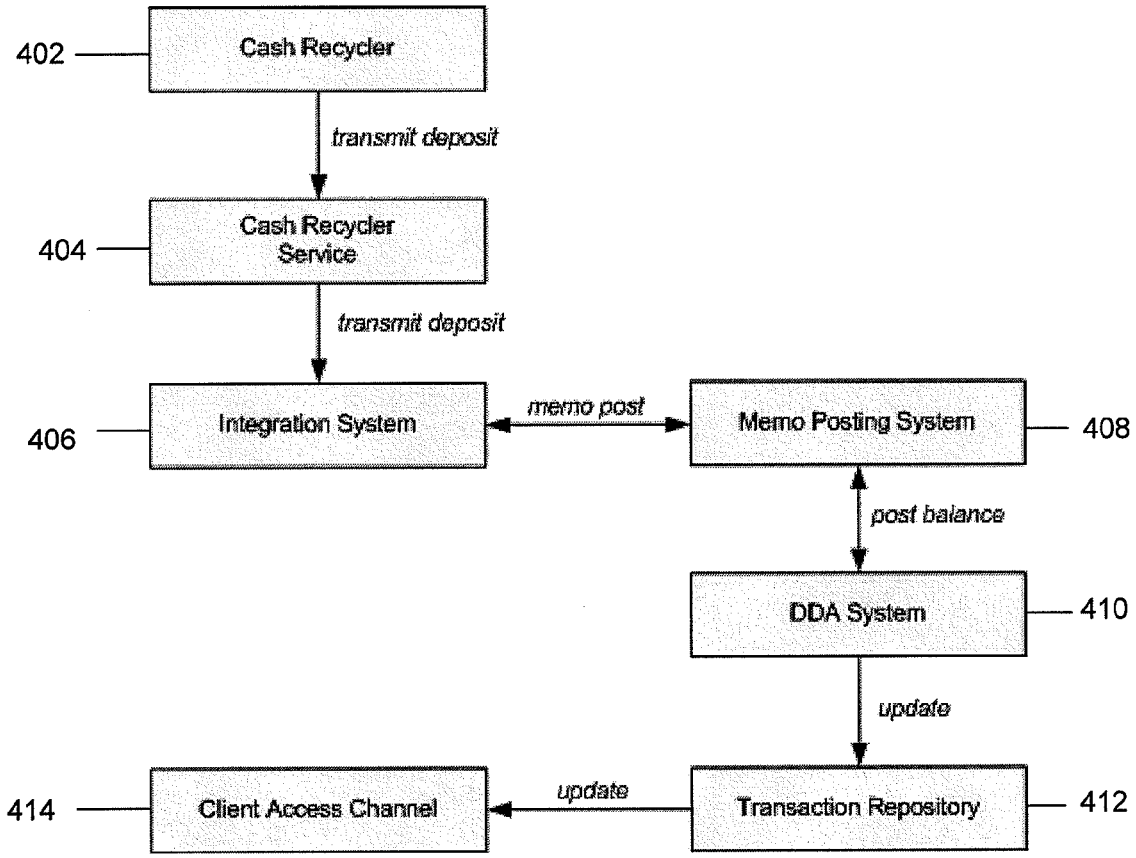
FIG. 4 illustrates a system configuration that may be used in accordance with an aspect of the invention.

FIG. 4 illustrates a system configuration that may be used in accordance with an aspect of the invention. In FIG. 4 a cash recycler 402 may communicate information to cash recycler service 404 located at a remote location. For example, cash recycler 402 may communicate deposit and withdrawal information from an enterprise location (e.g., a retail store) to the remote cash recycler service 404. The information may be routed through various networks such as the Internet to reach the cash recycler service. The cash recycler service 404 may be located in the data center of a financial institution. The cash recycler service 404 may communicate with an integration system 406 which provides access to the financial systems and processes. The integration system 406 may communicate with a memo posting system 408 which may perform posting activity. The posting system 408 may update the appropriate DDA (direct deposit account) system 410 to reflect the balance changes in the enterprises account balances. The DDA system 410 may also update a transaction repository 412 for historical and intra-day reporting purposes. An enterprise employee may access information stored in the transaction repository 412 through a client access channel 414 via web browser. Those skilled in the art will realize that the financial institution may allow the enterprise user to access the information stored in the transaction repository via numerous alternative communication methods.

According to one aspect, cash recyclers such as cash recycler 102 (FIG. 1) and 200 (FIG. 2) and other cash handling devices may facilitate real-time recognition of funds. In particular, funds deposited at a recycler or other cash handling device at a client site may be recognized by a bank at the time the deposit is made. Recognition refers to the real credit (i.e., not provisional) of deposited funds into a client's account. In contrast to current systems, there is no delay between a deposit of funds and when the funds and transaction data are submitted to the bank for recognition. Thus, instead of having to wait until the end of the day or another prescheduled time for deposits and/or withdrawals to be recognized by the bank, each deposit is processed for recognition in real-time. Data regarding the withdrawal or deposit transaction may be transmitted through a data network to the bank for recognition and processing. Providing real-time recognition offers may advantages including the ability for a client to withdraw the same currency that was earlier deposited for use in the client's operations, all at the client site and without having to first transport the deposited funds to the bank for recognition. Currency recyclers, recycling management and recognition of funds are further described in U.S. application Ser. No. 11/614,656, entitled "Commercial Currency Handling and Servicing Management," filed on Dec. 21, 2006, the content of which is incorporated herein by reference in its entirety.

Figure 5:
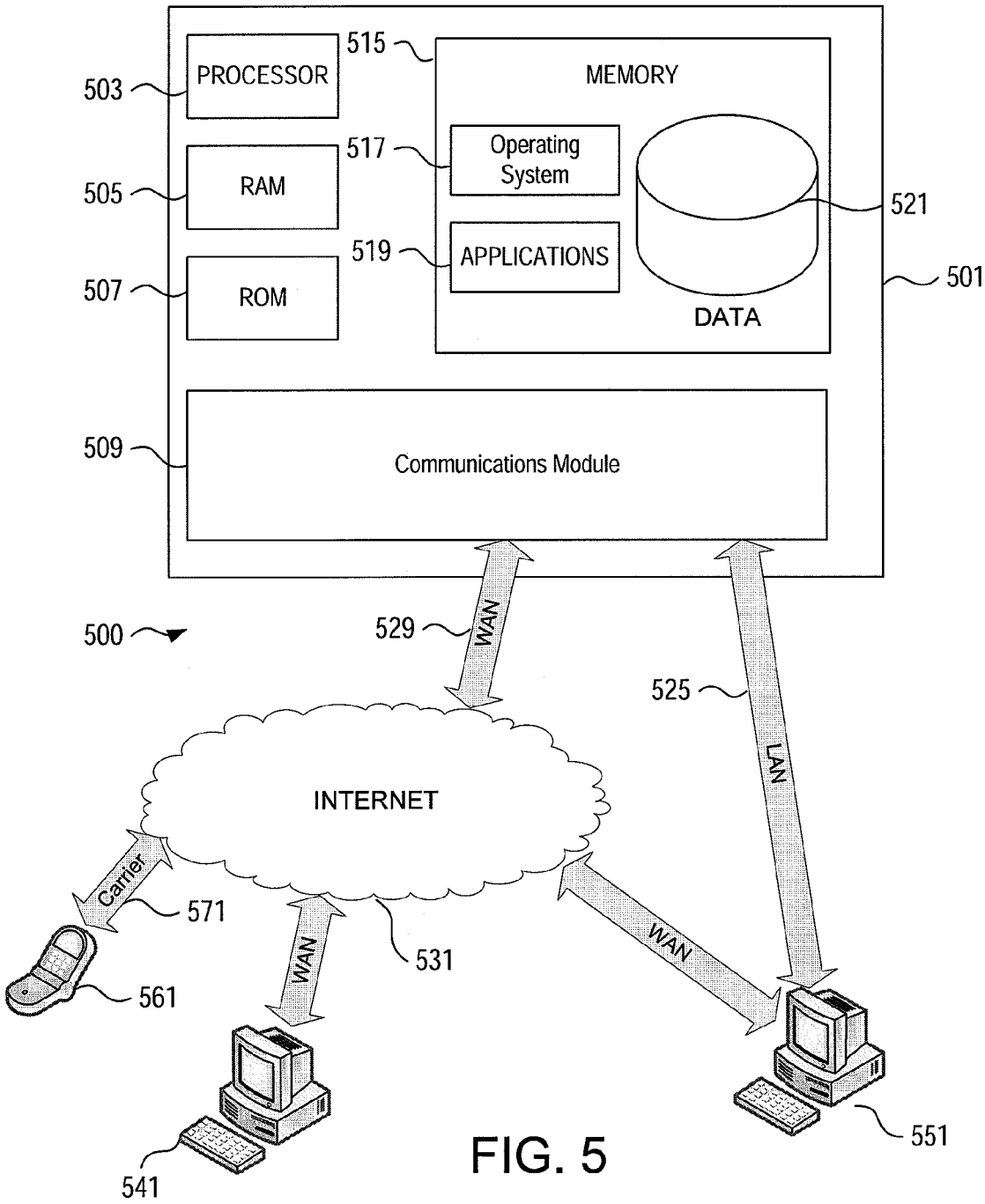
FIG. 5 shows an illustrative operating environment in which various aspects of the invention may be implemented in accordance with an aspect of the invention.

FIG. 5 illustrates an example of a suitable computing system environment 500 that may be used according to one or more illustrative embodiments. The computing system environment 500 is only one example of a suitable computing environment and is not intended to suggest any limitation as to the scope of use or functionality of the invention. The computing system environment 500 should not be interpreted as having any dependency or requirement relating to any one or combination of components shown in the illustrative computing system environment 500.

The invention is operational with numerous other general purpose or special purpose computing system environments or configurations. Examples of well known computing systems, environments, and/or configurations that may be suitable for use with the invention include, but are not limited to, personal computers, server computers, hand-held or laptop devices, multiprocessor systems, microprocessor-based systems, set top boxes, programmable consumer electronics, network PCs, minicomputers, mainframe computers, distributed computing environments that include any of the above systems or devices, and the like.

With reference to FIG. 5, the computing system environment 500 may include a computing device 501 wherein the processes discussed herein may be implemented. The computing device 501 may have a processor 503 for controlling overall operation of the computing device 101 and its associated components, including RAM 505, ROM 507, communications module 509, and memory 515. Computing device 501 typically includes a variety of computer readable media. Computer readable media may be any available media that may be accessed by computing device 501 and include both volatile and nonvolatile media, removable and non-removable media. By way of example, and not limitation, computer readable media may comprise a combination of computer storage media and communication media.

Computer storage media include volatile and nonvolatile, removable and non-removable media implemented in any method or technology for storage of information such as computer readable instructions, data structures, program modules or other data. Computer storage media include, but is not limited to, random access memory (RAM), read only memory (ROM), electronically erasable programmable read only memory (EEPROM), flash memory or other memory technology, CD-ROM, digital versatile disks (DVD) or other optical disk storage, magnetic cassettes, magnetic tape, magnetic disk storage or other magnetic storage devices, or any other medium that can be used to store the desired information and that can be accessed by computing device 501.

Communication media typically embodies computer readable instructions, data structures, program modules or other data in a modulated data signal such as a carrier wave or other transport mechanism and includes any information delivery media. Modulated data signal is a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media.

Although not shown, RAM 505 may include one or more are applications representing the application data stored in RAM memory 105 while the computing device is on and corresponding software applications (e.g., software tasks), are running on the computing device 501.

Communications module 509 may include a microphone, keypad, touch screen, and/or stylus through which a user of computing device 501 may provide input, and may also include one or more of a speaker for providing audio output and a video display device for providing textual, audiovisual and/or graphical output.

Software may be stored within memory 515 and/or storage to provide instructions to processor 503 for enabling computing device 501 to perform various functions. For example, memory 515 may store software used by the computing device 501, such as an operating system 517, application programs 519, and an associated database 521. Alternatively, some or all of the computer executable instructions for computing device 501 may be embodied in hardware or firmware (not shown).

Computing device 501 may operate in a networked environment supporting connections to one or more remote computing devices, such as branch terminals 541 and 551. The branch computing devices 541 and 551 may be personal computing devices or servers that include many or all of the elements described above relative to the computing device 501. Branch computing device 561 may be a mobile device communicating over wireless carrier channel 571.

The network connections depicted in FIG. 5 include a local area network (LAN) 525 and a wide area network (WAN) 529, but may also include other networks. When used in a LAN networking environment, computing device 501 is connected to the LAN 525 through a network interface or adapter in the communications module 509. When used in a WAN networking environment, the server 501 may include a modem in the communications module 509 or other means for establishing communications over the WAN 529, such as the Internet 531. It will be appreciated that the network connections shown are illustrative and other means of establishing a communications link between the computing devices may be used. The existence of any of various well-known protocols such as TCP/IP, Ethernet, FTP, HTTP and the like is presumed, and the system can be operated in a client-server configuration to permit a user to retrieve web pages from a web-based server. Any of various conventional web browsers can be used to display and manipulate data on web pages.

Additionally, one or more application programs 519 used by the computing device 501, according to an illustrative embodiment, may include computer executable instructions for invoking user functionality related to communication including, for example, email, short message service (SMS), and voice input and speech recognition applications.

Embodiments of the invention may include forms of computer-readable media. Computer-readable media include any available media that can be accessed by a computing device 501. Computer-readable media may comprise storage media and communication media. Storage media include volatile and nonvolatile, removable and non-removable media implemented in any method or technology for storage of information such as computer-readable instructions, object code, data structures, program modules, or other data. Communication media include any information delivery media and typically embody data in a modulated data signal such as a carrier wave or other transport mechanism.

Although not required, one of ordinary skill in the art will appreciate that various aspects described herein may be embodied as a method, a data processing system, or as a computer-readable medium storing computer-executable instructions. For example, a computer-readable medium storing instructions to cause a processor to perform steps of a method in accordance with aspects of the invention is contemplated. For example, aspects of the method steps disclosed herein may be executed on a processor on a computing device 501. Such a processor may execute computer-executable instructions stored on a computer-readable medium.

Figure 6:
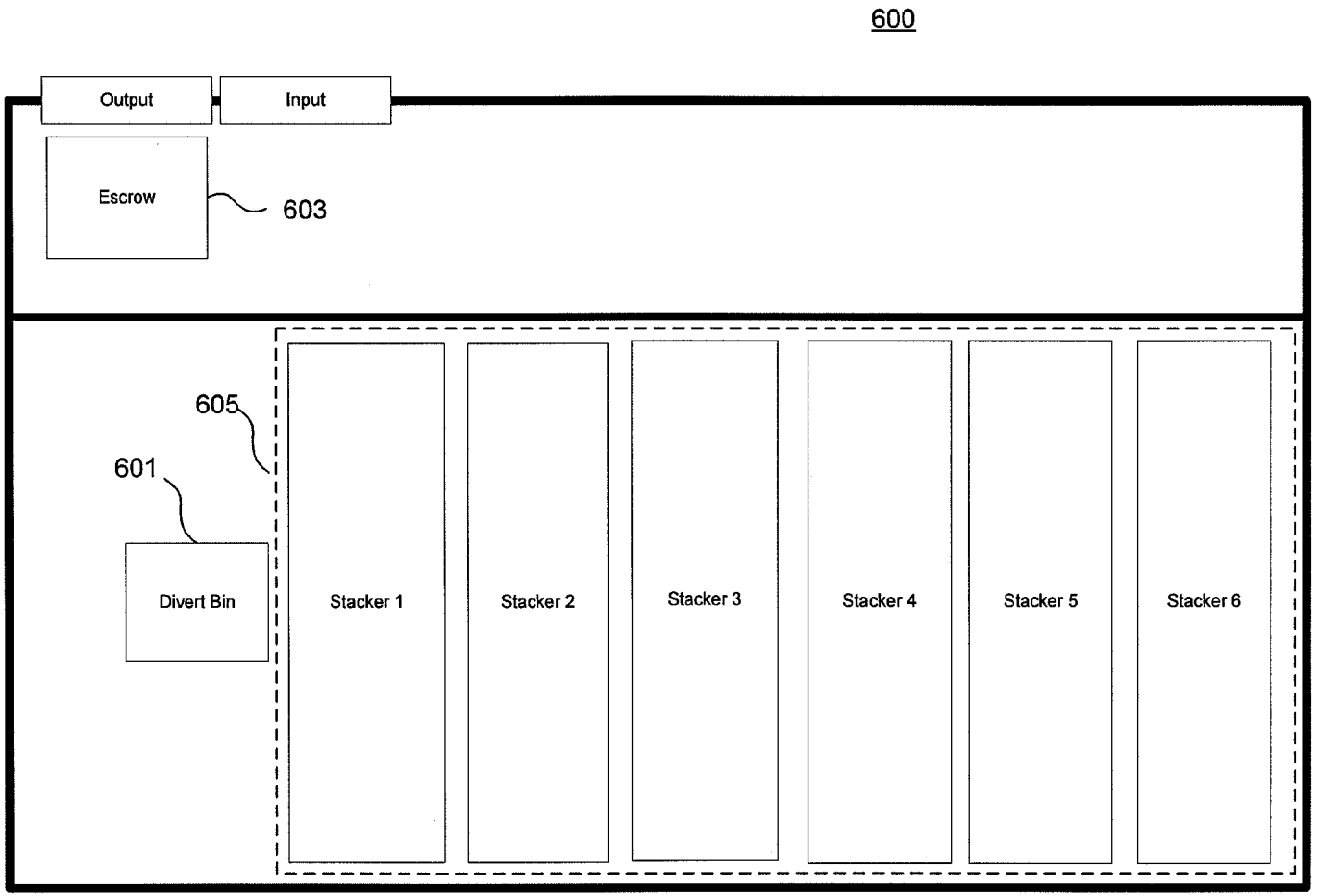
FIG. 6 (PRIOR ART)
FIG. 6 shows a cash handling device according to prior art.

FIG. 6 shows cash handling device 600 according to prior art. Traditional cash handling devices using stacking technology are typically unable to offer the option to "Cancel and Return Transaction." This limitation results from a traditional cash handling device 600 possibly returning "double-pick" notes when trying to extract notes from a stacker. (A double-pick note occurs when two or more notes are obtained from a stacker rather than one note. This may occur when notes stick together.) The double-picked notes are then sent to divert bin 601. Divert bin 601 is typically a non-recycling container that holds notes from multiple transactions. Consequently, when returning the "said" amount of the transaction, device 600 extracts the next note in the stacker in the attempt to return the "said" amount of the transaction. However, the notes would not be the actual and same notes that were put into device 600 for the transaction.

Traditional cash handling devices with stacker technology have attempted to circumvent the above limitation with the utilization of escrow bin 603. Before the notes are sent to stackers 605, the notes are first held within escrow bin 603. Should the user "Cancel and Return Transaction" before escrow bin 603 fills up, device 600 allows access to escrow bin 603 (by unlocking a passage door that is not shown) without trying to feed the funds to an output tray. A limitation occurs when the size of a transaction exceeds the handling capability of escrow bin 603, where all the notes cannot fit in escrow bin 603 at the same time. The user may be required to send escrow funds to stacker 605, at which point the "Cancel and Return" option is no longer available.

Figure 7:
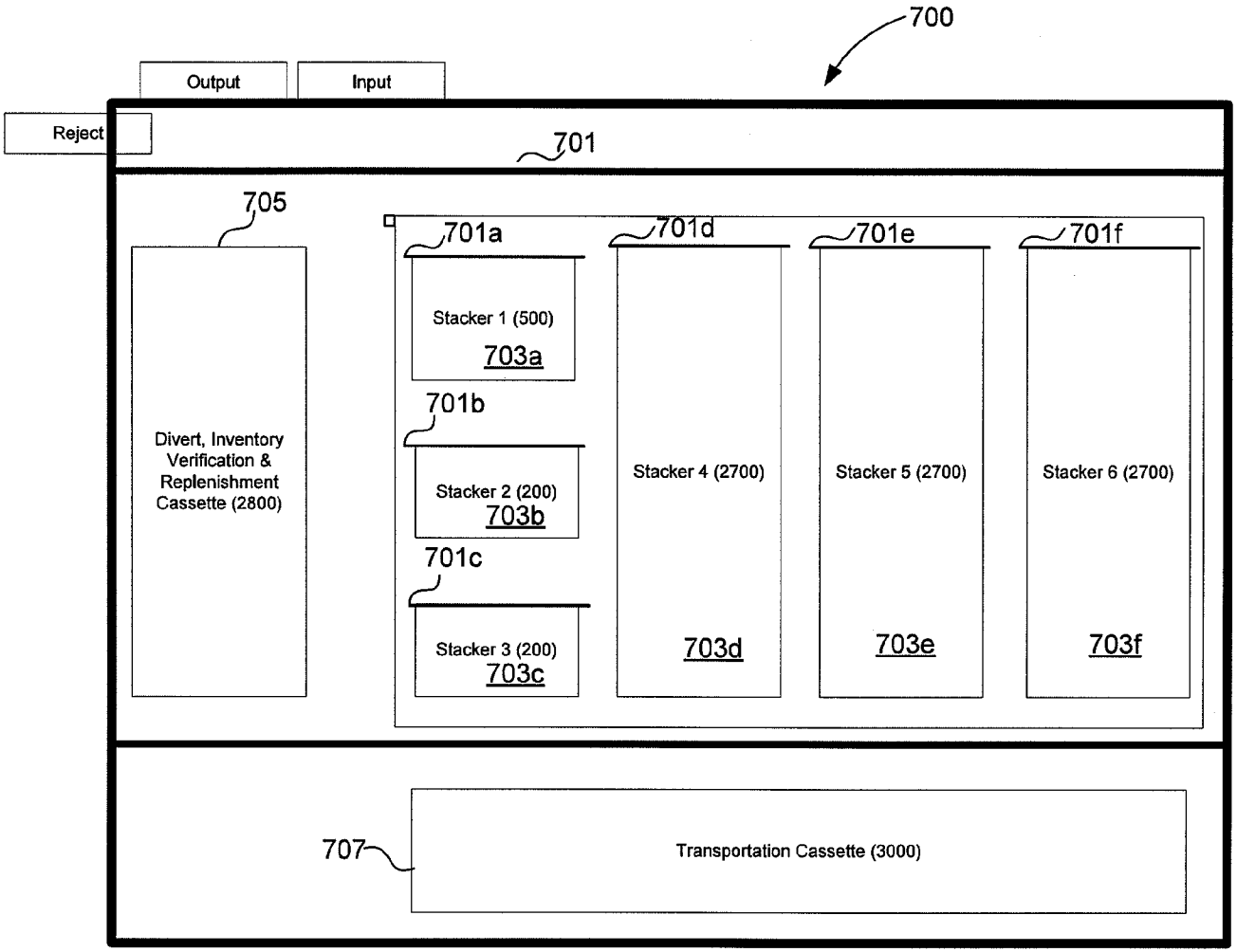
FIG. 7 shows a cash handling device in accordance with an embodiment of the invention.

FIG. 7 shows cash handling device (cash recycler) 700 in accordance with an embodiment of the invention. At the end of a transaction, plates 701*a-f*, which are moveable, extend over the funds for corresponding stackers 703*a-f*, respectively. As a new transaction occurs, the funds (e.g., cash and/or checks) lay on top of at least one of plates 701*a-f*. If a user requests to "Cancel and Return" the transaction, the notes (money) on top of a plate are picked off and returned to the user. Potential double pick notes can be either directly presented to the user because device 700 is just returning all notes down to extended plates 701*a-f* or routed to empty divert cassette 705 for re-processing back to the user after the stackers have been emptied. Should the user then complete the transaction, the money of the transaction "drops" down into stacking cassettes 703*a-f* when at least one plate 701*a-f* retracts and then extends back over the new notes from the transaction. At the end of the transaction, selected plates can retract and then extend back over all the notes for each stacker that sensed money had been laid on it. Alternatively, all plates can retract and extend at the end of a transaction.

Because of the extra security provided by plates 701*a-f*, the amount of money that needs to be auto-verified after a jam is less.

With other embodiments of the invention, cash handling device 700 supports situations in which the use of plates are not desired or are cost prohibitive. Potential double picks are routed to empty divert cassette 705 (does not hold notes from a previous transaction) and are immediately re-processed (where subsequent picks off the stacker are paused momentarily). This ensures all the identical notes from the cancelled transaction are returned to the user. The order in which the diverted notes are re-processed remain in the same order as they were picked off stackers 703*a-f* because there is the possibility that the "double-pick" occurred on the last note out of stackers 703*a-f* that was to be returned to the user. In that case, one (first) note of the double-pick will go to the user and the subsequent notes will return to stackers 703*a-f*. Notes of poor quality or of denominations that were to go directly to the overflow/carrier cassette 707 will need to temporarily "escrow" in divert bin 705. When the transaction is "cancelled" these notes would be the first notes returned to the user. When the transaction is completed, these notes would transfer to overflow/carrier cassette 707.

What is claimed is:

1. A cash recycling device comprising:

a first stacking cassette configured to receive a first deposited note from a user during a transaction;

a divert cassette configured, at the beginning of the transaction, to not hold notes from a previous transaction;

a first plate moveable over the first stacking cassette and configured to:

cover the first stacking cassette to prevent the first deposited note from entering the first stacking cassette before the transaction is completed by the user, wherein at least one deposited note is deposited by the user during the transaction; and retract to allow the first deposited note to enter the first stacking cassette when the transaction is completed; and an extraction mechanism configured to return the first deposited note to the user if the transaction is cancelled, wherein the extraction mechanism is further configured to route the first deposited note to the divert cassette for reprocessing the deposited note back to the user.

2. The cash recycling device of claim 1, wherein:

the first plate prevents a second deposited note from entering the first stacking cassette; and the extraction mechanism is configured to return the second deposited note to the user.

3. The cash recycling device of claim 1 further comprising:

a second stacking cassette;

a second plate moveable over the second stacking cassette and configured to:

cover the second stacking cassette to prevent a second deposited note from entering the second stacking cassette before the transaction is completed by the user; and retract to allow the second deposited note to enter the second stacking cassette when the transaction is completed; and an extraction mechanism configured to return the second deposited note to the user if the transaction is cancelled.

4. The cash recycling device of claim 1 further comprising:

a plurality of plates, wherein each plate is moveable over an associated stacking cassette and wherein only selected plates retract when the transaction is completed.

5. The cash recycling device of claim 1 further comprising:

a plurality of plates, wherein each plate is moveable over an associated stacking cassette and wherein all plates retract when the transaction is completed.

6. The cash recycling device of claim 1, wherein the extraction mechanism is further configured to return all identical notes from the cancelled transaction to the user when a double pick occurs, wherein the double pick occurs when more than one note rather than a single note is extracted from the first stacking cassette.

7. A cash recycling device comprising:

a stacking cassette configured to receive a deposited note from a user during a transaction;

a divert cassette configured, at the beginning of the transaction, to not hold notes from a previous transaction; and an extraction mechanism configured to:

extract the deposited note from the stacking cassette if the user cancels the transaction; and if the user cancels the transaction and a double pick occurs, divert extracted notes to the divert cassette for reprocessing the deposited note back to the user, wherein the double pick occurs when more than one note rather than a single note is extracted from the stacking cassette; and return the deposited note to the user, wherein the deposited note is a first extracted note of the double pick.

8. A cash recycling device comprising:

a stacking cassette configured to receive a deposited note from a user during a transaction;

a divert cassette configured, at the beginning of the transaction, to not hold notes from a previous transaction; and an extraction mechanism configured to:

extract the deposited note from the stacking cassette if the user cancels the transaction;

if the user cancels the transaction and a double pick occurs, divert extracted notes to the divert cassette for reprocessing the deposited note back to the user, wherein the double pick occurs when more than one note is extracted from the stacking cassette;

return the deposited note to the user, wherein the deposited note is a first extracted note of the double pick; and return remaining extracted notes of the double pick to the stacking cassette.

9. The cash recycling device of claim 8, wherein the extraction mechanism is further configured to:

determine which of the extracted notes are additional deposited notes from the transaction when the double pick occurs;

return the additional deposited notes to the user if the transaction is canceled; and return remaining extracted notes to the stacking cassette.

10. The cash recycling device of claim 8, wherein the extraction mechanism is further configured to:

extract another deposited note from the stacking cassette and repeat the divert, the return the deposited note, and the return the remaining extracted notes until all of the deposited notes from the transaction that are associated with the stacking cassette are returned to the user.

11. The cash recycling device of claim 8, further comprising:

a second stacking cassette; and the extraction mechanism further configured to:

extract a second deposited note from the second stacking cassette if the user cancels the transaction; and if the user cancels the transaction and a second double pick occurs, divert second extracted notes to the divert cassette.

12. The cash recycling device of claim 8, further comprising:

a transportation cassette; and the extraction mechanism further configured to:

divert poor quality notes to the divert cassette;

transfer the poor quality notes to the transportation cassette if the transaction is completed; and return the poor quality notes to the user if the transaction is canceled.

13. A computer-assisted method comprising:

covering a stacking cassette with a plate to prevent a deposited note from entering the stacking cassette before a transaction is completed by a user, wherein at least one deposited note is deposited by the user during the transaction;

retracting the plate to allow the deposited note to enter the stacking cassette when the transaction is completed; and returning the deposited note to the user if the transaction is cancelled, wherein the deposited note is routed to an empty divert cassette for reprocessing the deposited note back to the user.

14. A computer-assisted method comprising:

extracting a deposited note from a stacking cassette if a user cancels a transaction, wherein the deposited note is deposited by the user during the transaction; and if the user cancels the transaction and a double pick occurs, diverting extracted notes to an empty divert cassette for reprocessing the deposited note back to the user, wherein the double pick occurs when more than one note rather than a single note is extracted from the stacking cassette;

returning the deposited note to the user, wherein the deposited note is a first extracted note of the double pick; and returning remaining extracted notes of the double pick to the stacking cassette.

15. A non-transitory computer-readable storage medium storing computer-executable instructions that, when executed, cause a processor to perform a method comprising:

covering a stacking cassette with a plate to prevent a first deposited note from entering the stacking cassette before a transaction is completed by a user, wherein at least one deposited note is deposited by the user during the transaction;

retracting the plate to allow the deposited note to enter the stacking cassette when the transaction is completed; and returning the first deposited note to the user if the transaction is cancelled, wherein the first deposited note is routed to an empty divert cassette for reprocessing the deposited note back to the user.

16. The computer-readable storage medium of claim 15, wherein the instructions further cause the processor to perform:

preventing a second deposited note from entering the stacking cassette; and returning the second deposited note to the user.

17. The computer-readable storage medium of claim 15, wherein the instructions further cause the processor to perform:

covering a second stacking cassette to prevent a second deposited note from entering the second stacking cassette before the transaction is completed by the user; and retracting to allow the second deposited note to enter the second stacking cassette when the transaction is completed; and returning the second deposited note to the user if the transaction is cancelled.

18. A non-transitory computer-readable storage medium storing computer-executable instructions that, when executed, cause a processor to perform a method comprising:

extracting a deposited note from a stacking cassette if a user cancels a transaction, wherein at least one deposited note is deposited by the user during the transaction; and if the user cancels the transaction and a double pick occurs, diverting extracted notes to an empty divert cassette for reprocessing the deposited note back to the user, wherein the double pick occurs when more than one note rather than a single note is extracted from the stacking cassette; and returning the deposited note to the user, wherein the deposited note is a first extracted note of the double pick.

19. The computer-readable storage medium of claim 18, wherein the instructions further cause the processor to:

return remaining extracted notes of the double pick to the stacking cassette.

20. The computer-readable storage medium of claim 19, wherein the instructions further cause the processor to:

extract another deposited note from the stacking cassette and repeat the diverting, the returning the deposited note, and the returning the remaining extracted notes until all of the deposited notes from the transaction that are associated with the stacking cassette are returned to the user.

21. The computer-readable storage medium of claim 18, wherein the instructions further cause the processor to:

divert poor quality notes to the divert cassette;

transfer the poor quality notes to a transportation cassette if the transaction is completed; and return the poor quality notes to the user if the transaction is canceled.

* * * * *

UNITED STATES PATENT AND TRADEMARK OFFICE

CERTIFICATE OF CORRECTION

PATENT NO. : 8,172,067 B1
APPLICATION NO. : 12/485389
DATED : June 16, 2009
INVENTOR(S) : Amy Baker Folk et al.

It is certified that error appears in the above-identified patent and that said Letters Patent is hereby corrected as shown below:

In the Claims:

In Column 11, Claim 12, Line 10:
Please replace "claim 8" with --claim 7--

Signed and Sealed this
Seventh Day of May, 2013

Teresa Stanek Rea
*Acting Director of the United States Patent and Trademark Office*